US005425602A

United States Patent [19]

Seegmiller

[11] Patent Number: 5,425,602

[45] Date of Patent: Jun. 20, 1995

[54] SUPPORT SLING

[76] Inventor: Ben L. Seegmiller, 143 S. 400 East, Salt Lake City, Utah 84111

[21] Appl. No.: 113,339

[22] Filed: Aug. 30, 1993

[51] Int. Cl.[6] ..... E21D 20/00

[52] U.S. Cl. ..... 405/302.2; 405/288; 403/302; 403/310

[58] Field of Search ..... 405/259.1, 272, 288, 405/302.2; 403/302, 310, 311, 353

[56] References Cited

U.S. PATENT DOCUMENTS

| | | | |
|---|---|---|---|
| 34,769 | 3/1862 | Northrup | 403/310 |
| 1,209,623 | 12/1916 | Rush | 403/311 |
| 1,380,127 | 5/1921 | Welch et al. | 403/310 |
| 1,853,681 | 4/1932 | Hayes | 403/311 X |
| 2,386,473 | 10/1945 | Kanary | 403/310 |
| 3,505,824 | 4/1970 | White | 405/302.2 |
| 3,791,751 | 2/1974 | Vey | 403/311 |
| 4,596,496 | 6/1986 | Tyrell et al. | 405/288 |
| 4,601,616 | 7/1986 | Barish et al. | 405/288 |
| 4,630,974 | 12/1986 | Sherman | 405/288 |
| 4,776,729 | 10/1988 | Seegmiller | 405/288 |
| 4,934,873 | 6/1990 | Calandra | 405/288 |
| 4,946,315 | 8/1990 | Chugh et al. | 405/288 |
| 5,238,329 | 8/1993 | Long et al. | 405/288 |

*Primary Examiner*—Dennis L. Taylor
*Assistant Examiner*—John A. Ricci
*Attorney, Agent, or Firm*—M. Ralph Shaffer

[57] ABSTRACT

A support sling, useful in the mining industry, for example, for supporting overhead loads such as mine roofs; the sling includes a pair of generally coplanar anchor lengths, sometimes called anchor bolts, having inwardly directed ends mutually facing each other and which, thus, are essentially coaxial; a similarly coaxial take-up coupling structure secures the ends and is constructed, either in active or passive mode, to restrain loads, acting under the force of gravity, from dilating downwardly to extreme conditions, and this in a manner as not to allow for the generation of serious force couples in the sling.

7 Claims, 3 Drawing Sheets

SUPPORT SLING

FIELD OF INVENTION

The present invention relates to slings and, more particularly, to support slings useful in the mining industry, for example. Noticeably absent in the present invention is the generation of pronounced force couples as the action of the sling comes into play; rather, the sling, with a minimum of structural requirements, involves a take-up and permissible tensioning of coupler structure between a pair of mutually opposed and mutually spaced anchor lengths or bolts, wherein such coupler structure acts essentially coaxially with such anchor lengths as to the latter's innermost ends.

BACKGROUND AND BRIEF DESCRIPTION OF PRIOR ART

The inventor herein has secured several U.S. patents bearing upon the general field of the invention, as follows, which are cited for general background purposes:

| | | |
|---|---|---|
| 4666344 | 4775266 | 4960348 |
| 4699547 | 4776729 | 5026217 |

Many of these patents rely upon the employment of corner truss brackets which are installed proximate the roof-rib corner junction areas. Upwardly and outwardly angulated mine roof bolts secure the brackets in place, and the roof bolts are placed under substantial tension by tightening nuts as well as by tie rod or other trussing structure which is connected to the brackets and also placed in tension. When in active mode, that is, when the over-all truss is placed in tension, then a true truss effect is imposed on mine roof strata, placing the same in compression and thus deterring the falling down or essential dilation of the mine roof. This is produced by the resultant upwardly and inwardly directed force vectors, generated at the brackets, which are directed upwardly in the strata inwardly of the brackets. This is a highly preferred way of supporting mine roofs, for example. But this approach is expensive.

For certain types of strata conditions, it may well be desirable to utilize a support system which is less expensive, and yet will operate quite satisfactorily where extreme conditions are not encountered. Thus, where the corner brackets can be eliminated and the pre-tensioning of the anchor bolts omitted, expense is measurably reduced. This tack leads to a sling approach, whether in active or passive mode: this is to say, whether the sling is actively placed in tension initially, or whether the tension is produced through the dilation downwardly of the mine roof surface. A sling has been conceived in the mining art, see U.S. Pat. No. 5,193,940 (Long). However, such a sling, it is submitted, subjects the connecting structure and/or one or more of its component parts to failure or even fracture. Such is chanced by the generally non-coaxial nature of the coupling structure, as by rods utilized which are not coaxial as herein, but rather are coupled together in a pronounced off-center condition. This results in the generation of force couples which tend to warp and even shear or otherwise fracture portions of the connecting structure. The present invention avoids these difficulties.

BRIEF DESCRIPTION OF INVENTION

According to the present invention the support sling comprises a pair of essentially coplanar, mutually opposite anchor bolts or anchor lengths, suitably designed for installation in pre-drilled bore holes. The mutually facing and mutually spaced inward ends of the anchor lengths are essentially coaxial. Coupler structure is secured to and between such inward ends and essentially comprises the sling portion of the structure. Such coupler structure includes take-up and permissively tensioning structure which acts essentially coaxially with and is aligned with said inward ends. Provision is made for either threaded connections, headed-reaction-type connections, a combination of both, or otherwise. Slotted connector members, threaded connectors,. etc., can be advantageously employed as hereinafter pointed out. When take-up is applied, and sling tensioning results, either presently or prospectively, the forces of tension will be rectilinear with the inwardly facing ends of the anchor lengths, precluding inadvertent fracturing and warpage by the imposition of load, whether produced by dilation, active tensioning take-up, or otherwise. A method for effecting sling-support, cognizant of the above features, is set forth in detail hereinafter.

OBJECTS

Accordingly, a particular object of the present invention is to provide an improved support sling, and also a method for effecting sling-type load support.

A further object is to provide a support sling for the mining industry wherein the generation of force couples within the sling are substantially reduced if not eliminated.

A further object is to provide a support sling wherein headed connections, threaded connections, a combination of both, etc., are accommodated, and this still in a design preserving wide ranges of adjustment and take-up whereby to accommodate installation and progressive take-up and tensioning, as may be desired.

DRAWINGS

The features of the present invention may best be understood by reference to the following description, taken in connection with the accompanying drawings, in which.

Figure 1:
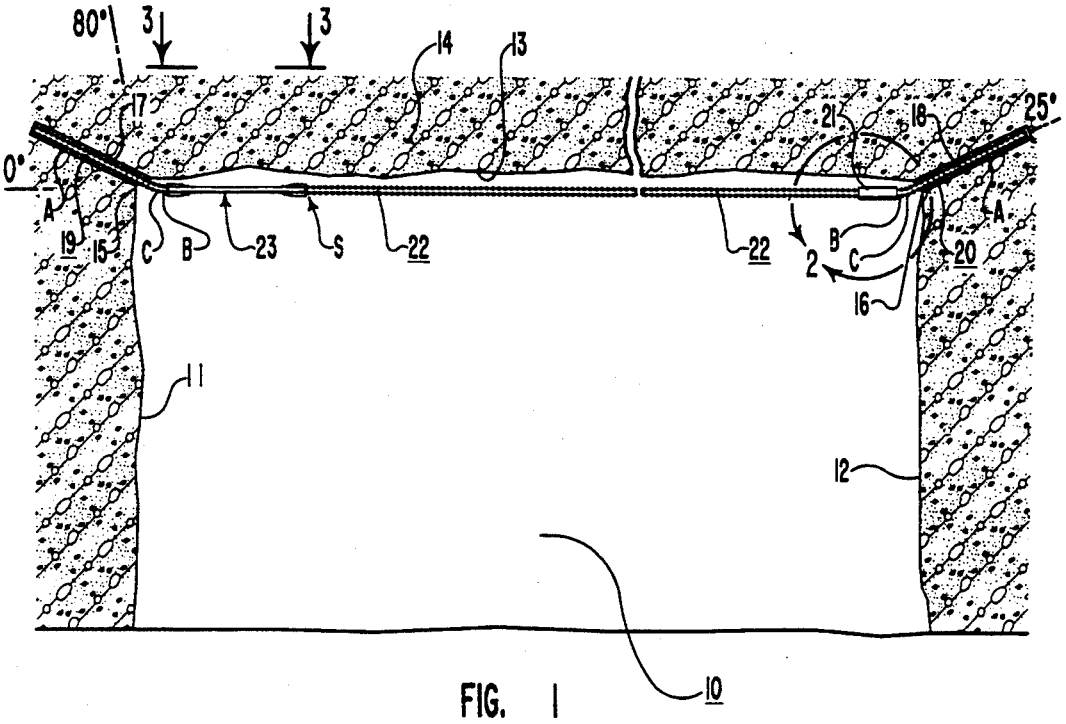
FIG. 1 is a front elevation, partially in section, of a sling support constructed in accordance with the present invention and installed in an underground mine.
Figure 3:
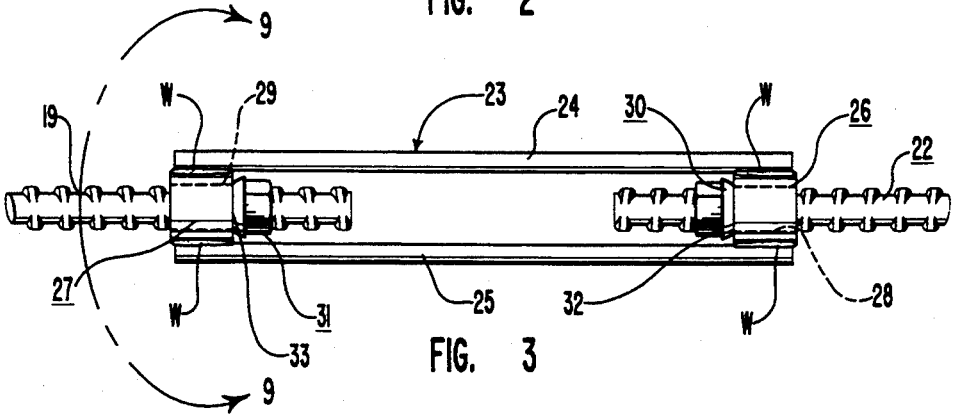
FIG. 3 is an enlarged plan view of a retainer unit that can be utilized, and is taken along the section-line 3—3 in FIG. 1.
Figure 7:
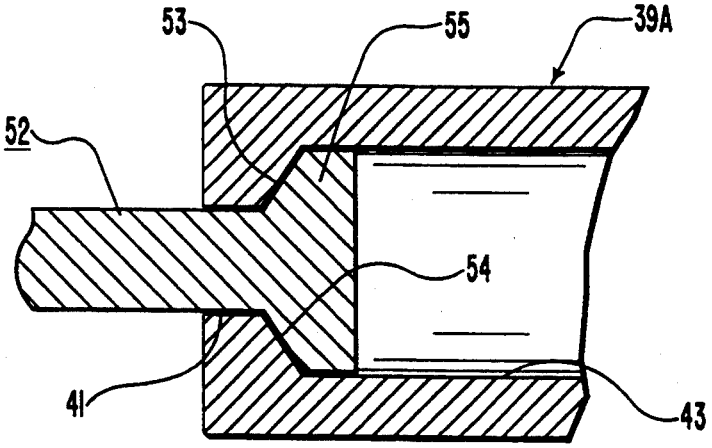
FIG. 7 is an enlarged fragmentary view, shown in section, of an alternate construction for one or both ends of the engaged coupler and anchor length, or anchor bolt, in FIG. 6, indicating a centering feature in the form of a chamfered junction, whereby to avoid inadvertent disengagement.
Figure 8:
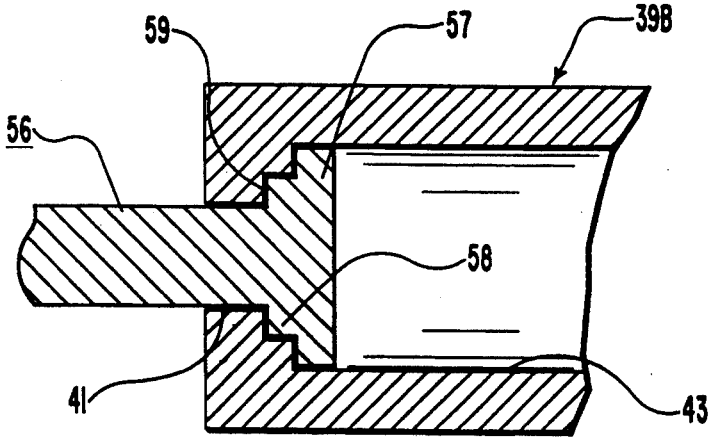
FIG. 8 is similar to FIG. 7, indicating an anternate end construction relative to the coupler wherein a cylindrically arcuate seat is provided one or both of the inner engagement faces of the coupler, whereby to seat cylindrical centering portions or bosses association with the head of an anchor length, for example, and for the same purpose as stated with reference to FIG. 7.
Figure 9:
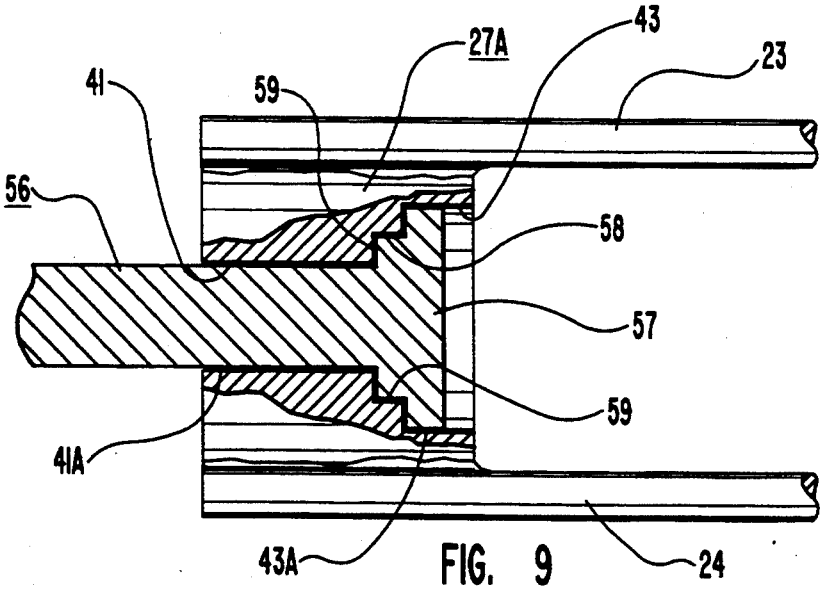

FIG. 9 is similar to FIG. 8 but is an enlarged detail, taken along the line 9—9 in FIG. 3, indicating the manner in which one of the ends of the take-up retainer unit, see 23 in FIGS. 1 and 3, can be modified so as to eliminate the use of one nut and still provide the function desired; the form of FIG. 7 might be substituted and employed equally as well.

DETAILED DESCRIPTION OF PREFERRED EMBODIMENTS

Figure 2:
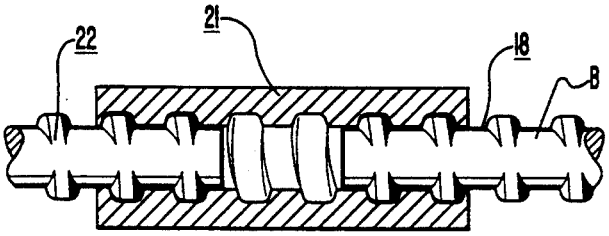
FIG. 2 is an enlarged-detail, partly in section, and taken along the arcuate line 2 in FIG. 1.

In FIGS. 1–3, mine opening 10 is defined by sides or ribs 11 and 12 and also roof surface 13 above which is roof strata 14. Ribs 12, 13 and roof surface 13 define corner areas 15 and 16 proximate which respective bore holes 17 and. 18 are pre-drilled into the mine strata. Inserted in these respective bore holes are the mine roof anchor bolts or lengths 19 and 20, which may be threaded in at least one form of the invention at least at their inwardly directed extremities. These, with their respective bore holes, preferably assume an angulated orientation, with respect to the horizontal, of nominally 25 degrees, the permissible range, depending upon the type of strata and work being performed, varying from zero degrees to 80 degrees relative to the horizontal, as illustrated in FIG. 1. In practice the 25 degree orientation is preferred from design considerations for maximizing anchor bolt retention and the production of at least some compression in the strata. Each of the anchor lengths has a principal portion A and an attachment receiving portion B. Where the zero degree orientation, as above identified, has been selected, then of course portions A and B will be rectilinear. Where there is a positive angular orientation as to the respective bore holes relative to the horizontal, then there will be a dog-leg or angular orientation as to respective portions A and B, which are respectively integrally joined at bend areas C.

In FIGS. 1 and 2 there is seen an internally threaded cylindrical coupler 21 which threadedly receives the threaded end of anchor length 18 and also the right threaded end of tie rod 22. In practice, the coupler 21 will be provided and pre-threaded part-way onto the tie rod 22; subsequently, the tie-rod with the coupler will be manually revolved so that the coupler threads onto the threaded end of portion B of anchor length 18.

FIGS. 1 and 3 illustrate the inclusion of a take-up and/or tensioning retainer unit 23. This unit includes a pair of coplanar, parallel, elongated spacer rods 24 and 25 which, at their respective opposite ends, are welded at W or otherwise secured to opposite sides of respective apertured reaction members 26 and 27. These reaction members can resemble stub cylinders or plugs having central apertures 28 and 29. Accordingly, the respective ends of tie rod 22 and anchor length 19 pass through the apertures 28 and 29 and are secured by interiorly threaded take-up nuts 30 and 31. The latter may include the standard, integral, self-centering, hemispherical, hollow inner ends 32 and 33 which accomplish the centering function as is commonly understood in the art. The axes of holes or apertures 28 and 29 will be generally aligned so that no mechanical force couple is generated when tension is applied through the tightening of one or both nuts 30 and 31. In this way, warpage and fracture are not chanced, and tensioning can be maximized in a safe manner.

In assembly, the right end of anchor length 19 is inserted into and freely slipped through reaction member 27 as the tensioning retainer unit is advanced to the left of the viewer. Nut 31 is preliminarily installed. Subsequently, the left end of the tie rod 22 is freely slipped through the aperture 28 of reaction member 22, and nut 30 is subsequently threaded onto the tie rod. The overall length of the unit 23 can be of the order of 24 inches, with the end reaction members 26 and 27 each being about 2 inches thick in an axial direction. This allows for sufficient adjustment and take-up to accommodate different discrete lengths of tie rods, mine opening widths, variation in tensioning pressures, etc.

As to anchor lengths 18 and 19, these will be anchored in their respective bore holes by grout, epoxy resin, etc. in customary fashion, in either a full column anchor, where the resin fills the bore hole about the respective length, or in a point anchor mount, where the resin'section is proximate the end of the bore hole. In practice and by way of example only, it may be desirably to use five-foot length anchor lengths, a four foot section of each being portions A, and approximately one foot of each comprising portions B in the drawings.

In operation, when the support sling S is tightened as through the tightening of one or both nuts 32 and 33, tensioning will be produced which will result in slight, upwardly and inwardly oriented force vectors being generated proximate the corners 15 and 16. In the main, however, the sling is simply tightened to provide a sling-type support against dilation of the upper roof surface. In this respect the concept differs from a pure truss action wherein roof strata stability is maintained through essentially exclusive action of such force vectors as are generated through independent tensioning of both end anchor bolts or lengths and the tie rods and other structures utilized in cases of other trusses, as is amply demonstrated in the inventor's other patents as above recited.

As is seen, the support sling S comprises the respective anchor lengths 19 and 20, tie rod 22, coupler 21, tensioning retainer unit, 23, and nuts 31 and 32.

Figure 4:
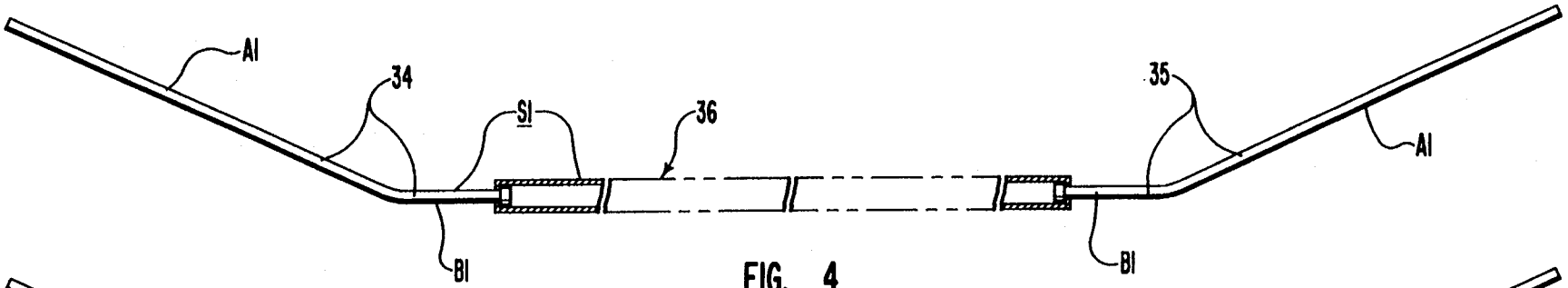
FIG. 4 is a side-elevation of a support sling shown in generic form.

In FIG. 4 sling S1 is shown in generalized, generic form, indicating the basic principle that anchor lengths 34 and 35, customarily referred to in the industry as anchor bolts, each comprise principal portions A1, which are secured in the respective bore holes of roof strata, and portions B1 which are respectively integral therewith. In practice, the anchor lengths will be first installed, as by epoxy, etc. Epoxy mixing is made completely effective where the anchor lengths comprise customary re-bar having the usual external surface deformations. Then, a machine is used to bend length portions B1 upwardly to assume a generally horizontal position as indicated. The anchor lengths may be partly threaded at their inner ends, completely threaded, or not threaded at all; likewise, they may have heads, if desired, at their inner ends at least. FIG. 4 illustrates that a generic tensioning coupler, of any form, can be employed to couple together the inwardly directed ends of anchor lengths 34 and 35. Such a coupler 36 with the two anchor lengths 34 and 35 comprise the roof support sling. Further, since corner anchor brackets need not be employed, then the sling function is operative rather than a pure truss effect, as hitherto explained.

Figure 5:
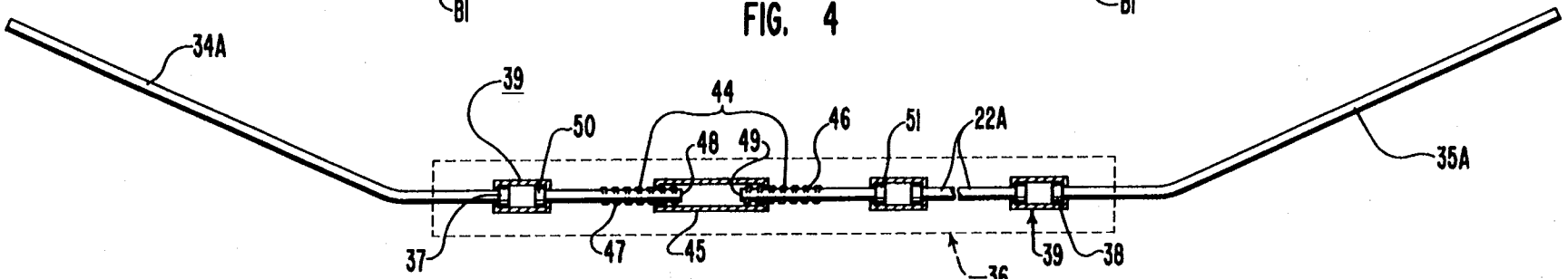
FIG. 5 is similar to FIG. 4 but illustrates another embodiment, and is partially in section.
Figure 6:
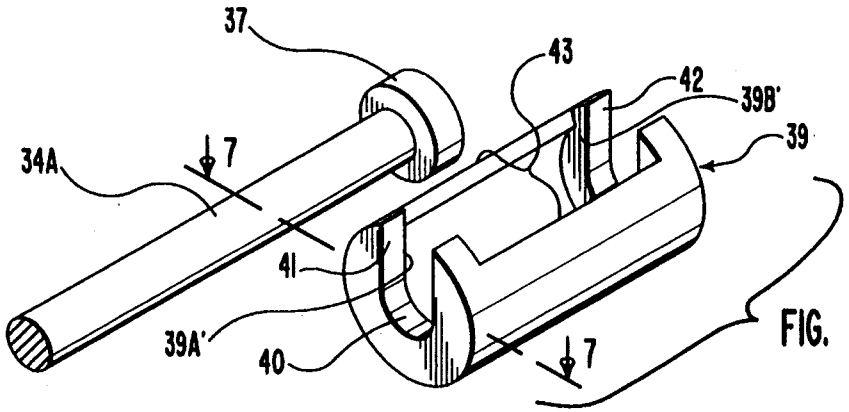
FIG. 6 is an exploded view of a coupler connection useable in the construction in FIG. 5, at the right and left coupler member locations.

FIG. 5 illustrates another form that the sling S1 can take, this time incorporating conventional turnbuckle 44. Thus, anchor lengths 34A and 35A, corresponding to anchor lengths 34 and 35 in FIG. 4, have at their respective inner ends an enlargement or head 37 and 38, respectively, which can be formed either before installation or afterwards, as by use of a conventional upsetter tool. A pair of couplers 39, with reaction engagement surfaces 39A, 39B, see FIG. 6, are employed in the manner indicated. Each coupler is hollow, having aperture 40, is generally cylindrical in preference, and has end slots 41 and 42 contiguous with headed-end admittance slot 43. Accordingly, the heads of the lengths to be secured by the couplers, simply, for example, by the length 34A being slipped into slot 42, the head 37 advancing through enlarged slot 43, so that when the length end is disposed inside the coupler, the coupler is effective to restrain outward axial movement of the anchor length relative to the coupler. A similar installation, with similar effect, applies as to all of the headed elements, i.e. turnbuckle lengths 46 and 47, tie rod ends of tie rod 22A, etc. Thus, sling S1, as to FIG. 5, takes the form illustrated, with generic tensionable coupler taking the form so shown.

In FIG. 7 anchor length 52, corresponding to anchor length 34 in FIG. 4, has a conically formed, tapered, or chamfered surface 53, at its raised head 55, which seats against the corresponding chamfered surface 54 of coupler 39A, corresponding to coupler 39 in FIG. 6. The coupler will retain, of course, the central aperture having contiguous end slots 41 and 42 as well as widened slot 43, as before. The structure can be utilized at both ends of the substitute coupler.

FIG. 8 is similar to FIG. 7 but illustrates that anchor length 56, also corresponding to anchor length 34, includes head 57 provided with annular seating shoulder portion 58. This seats against generally arcuately cylindrical depression 59 formed in coupler 39B. The annular nature of the seat will be interrupted solely by its own slot 41, see also FIG. 6.

FIG. 9 illustrates an alternate end structure for retainer unit 23. Rods 23, 24 are welded, as before, to the opposite sides of cylindrical reaction member 27A, corresponding to reaction member 27 in FIG. 3. This time, member 27A has a central bore 41 which is provided with a cylindrically formed seat 59 contiguous therewith, see also FIG. 8. Anchor length 56 has head 57 provided with positioning ring or shoulder portion 58. Member 27A will of course be provided with slots 41A and 43A contiguous with aperture 41, and similar to slots 41 and 43 in FIG. 6, for receiving the anchor length 56 with its head 57.

The structures of FIGS. 7-9 illustrate that the centering structures relative to the heads and their seats provided for centering and stability, ensuring against lateral slippage.

Preferred embodiments are shown, but are not to be understood as delimiting. Thus, securement and integration of the slings may be by threaded attachments, headed attachments, or otherwise, so long as the tightening of the sling does not essentially produce force couples which would tend to produce warpage and/or fracture. An essential point is that the general orientation of the sling is rectilinear and horizontal, relative to the essentially aligned inner ends of anchor lengths 34, 35, 34A, 35A, and so forth.

A method for practicing the invention can thus be set forth as follows: providing coplanar bore holes in mine roof strata; providing anchor lengths; inserting and anchoring said anchor lengths with said bore holes, respectively; bending said anchor lengths, once installed, at respective intermediate points whereby to form essentially horizontal attachment receiving, anchor length inner portions which are essentially mutually coaxial; providing elongated support coupler structure for securement to and between said attachment receiving portions, said coupler structure having take-up structure rectilinearly aligned and coaxially operative, with respect to said attachment receiving portions, for reducing slack and providing permissible tension to said sling; and, finally, tightening said take-up structure.

One final point: the obtuse angle defined by each of the anchor lengths 19 and 20 in FIG. 1, when the incline angle relative to the horizontal is maintained, as previously described, at a preferred twenty-five degree relative to the horizontal, will of course be of the order of one hundred fifty-five (180–25) degrees.

While particular embodiments of the present invention have been show and described, it will be obvious to those skilled in the art that various changes and modifications may be made without departing from the essential features of the invention, and therefore, the aim in the appended claims is to cover all such changes and modification as fall within the true spirit and scope of the invention.

I claim:

1. A support sling for supporting a load disposed thereover and including, in combination, a pair of opposite side anchor lengths each having an outwardly extending anchor portion and an inwardly extending attachment receiving portion respectively contiguous with said outwardly extending anchor portion, and coaxially operative take-up coupler structure means, interconnected to and between said attachment receiving portions, for supporting a load positioned thereabove, the combination of said coupler structure means and said anchor lengths including plural, headed reaction means and a coupler member having reaction ends and a side slot intermediate of said ends for receiving for installation and mutual retention of said plural headed reaction means.

2. A coupler member comprising a hollow elongate body provided with mutually opposite reaction ends having interior respective reaction engagement surfaces, said ends having respective side slots bottoming in coaxial aperture portions and each dimensioned to receive the shank of respective external members provided with headed ends, said body being provided with a side opening larger in girth than said side slots for admitting said headed ends to the interior of said body, said interior reaction engagement surfaces having recesses about said aperture portions whereby to cooperate in seating said headed ends.

3. The coupler member of claim 2 wherein said recesses each comprise chamfer seats.

4. The coupler member of claim 2 wherein said recesses comprise essentially cylindrical seats.

5. A coupler member comprising a hollow elongate body provided with mutually opposite reaction ends having interior respective reaction engagement surfaces, said ends having respective side slots bottoming in coaxial aperture portions and each dimensioned to receive the shank of respective external members provided with headed ends, said body being provided with a side opening larger in girth than said said side slots, said interior reaction engagement surfaces having recesses disposed about said aperture portions, and a pair of elongate members having headed ends provided with centering boss portions slipped through said side slots and said side opening and engaging said reaction engagement surfaces, respectively, and dimensioned to constitute with said recesses a pair of respective mutual seating junctions.

6. A retainer unit including, in combination, a pair of mutually spaced, coaxially aligned reaction members provided with coaxially aligned respective apertures, a first elongate member positioned through said aperture of one of said reaction members, nut means threadedly securing said first elongate member to said one reaction member, the remaining one of said reaction member being provided with a side slot contiguous with its said aperture, and an elongate element having a headed end slipped through said side slot and engaging at said headed end said remaining reaction member, and a pair of elongate members fixed to said reaction members for fixedly spacing apart said reaction members.

7. The retainer unit of claim 6 wherein said headed end has a seating protuberance, said remaining reaction member being provided with a recessed area mutually cooperating in a seat relationship with said protuberance.

* * * * *